US007926674B2

(12) United States Patent
Luburic

(10) Patent No.: US 7,926,674 B2
(45) Date of Patent: Apr. 19, 2011

(54) CONTAINER WITH SEAL

(75) Inventor: Frano Luburic, Anaheim Hills, CA (US)

(73) Assignee: Ropak Corporation, Fountain Valley, CA (US)

( * ) Notice: Subject to any disclaimer, the term of this patent is extended or adjusted under 35 U.S.C. 154(b) by 404 days.

(21) Appl. No.: 11/615,436

(22) Filed: Dec. 22, 2006

(65) Prior Publication Data

US 2008/0149639 A1 Jun. 26, 2008

(51) Int. Cl.
*B65D 51/20* (2006.01)

(52) U.S. Cl. ..... 220/258.1; 220/276; 220/359.2; 220/780; 220/783

(58) Field of Classification Search ..... 220/258.1, 220/276, 359.2, 780, 783
See application file for complete search history.

(56) References Cited

U.S. PATENT DOCUMENTS

| | | | | |
|---|---|---|---|---|
| 4,682,702 | A * | 7/1987 | Gach | 222/541.9 |
| 4,801,041 | A | 1/1989 | Takata et al. | |
| 5,178,293 | A | 1/1993 | Suzuki et al. | |
| 5,511,680 | A * | 4/1996 | Kinne | 206/276 |
| 6,196,404 | B1 | 3/2001 | Chen | |
| 6,371,324 | B1 | 4/2002 | Torniainen et al. | |
| 6,761,279 | B1 * | 7/2004 | Martin et al. | 220/258.2 |
| 6,971,539 | B1 * | 12/2005 | Abbe | 220/592.13 |
| 2001/0047994 | A1 * | 12/2001 | von Holdt, Jr. | 220/276 |
| 2005/0269328 | A1 | 12/2005 | Crider et al. | |

* cited by examiner

*Primary Examiner* — Anthony Stashick
*Assistant Examiner* — Elizabeth Volz
(74) *Attorney, Agent, or Firm* — Vedder Price P.C.

(57) ABSTRACT

An apparatus, according to one embodiment, for storing a product comprising a lid including a tongue; and a clamp; and a container including a groove, wherein the tongue and the groove form a seal when the lid is coupled to the container; and a bead, wherein the clamp engages with the bead when the lid is coupled to the container. An apparatus, according to another embodiment, for storing a product comprising a lid; a container configured to engage with the lid and form a secondary seal between the lid and the container; and a film seal coupled to the container.

38 Claims, 5 Drawing Sheets

CONTAINER WITH SEAL

BACKGROUND

1. Field of the Invention

The present invention relates to containers. More specifically, the present invention relates to containers with a sealing mechanism.

2. Discussion of the Related Art

There are containers that utilize a thin film seal to keep contents either moisturized or isolated from moisture. For example, wet moisture wipes that are used to clean floors or other surfaces are stored in a container that has a lid. Generally, when manufactured a film seal is included across the top of the container to form a moisture tight barrier. In use, after removal of the lid, the film seal can also be removed and the moisture wipes can be accessed. However, the film seal is not reusable and thus, the lid now forms the only barrier between the container and the outside of the container. In general, the lid does not provide a seal even after being placed back on the container. This leads to the moisture wipes becoming dried out. A similar problem exists with any liquid product, tea, coffee, or any other product that is moisturized or should be isolated from moisture.

Thus, a container that can provide a seal after removal of a thin film seal from the top of the container is needed.

SUMMARY

Some embodiments provide a container and lid that include both a film seal and a secondary seal, the secondary seal capable of being engaged before and after the film seal has been removed. Some other embodiments provide a container and lid including a tongue and groove forming a seal, the container and lid further including a bead and clamp that provide a force to keep the tongue and groove engaged.

One embodiment can be characterized as an apparatus, according to one embodiment, for storing a product comprising a lid including a tongue; and a clamp; and a container including a groove, wherein the tongue and the groove form a seal when the lid is coupled to the container; and a bead, wherein the clamp engages with the bead when the lid is coupled to the container.

Another embodiment can be characterized as an apparatus, according to another embodiment, for storing a product comprising a lid; a container configured to engage with the lid and form a secondary seal between the lid and the container; and a film seal coupled to the container.

A subsequent embodiment includes a method comprising forming a film seal on a top of a container; engaging a lid with the container; and forming a secondary seal with a tongue and a groove between the lid and the container. Optionally, the method further includes engaging a bead and a clamp to provide a force between the tongue and the groove that form the secondary seal.

BRIEF DESCRIPTION OF THE DRAWINGS

The above and other aspects, features and advantages of the present invention will be more apparent from the following more particular description thereof, presented in conjunction with the following drawings, wherein.

Figure 2:
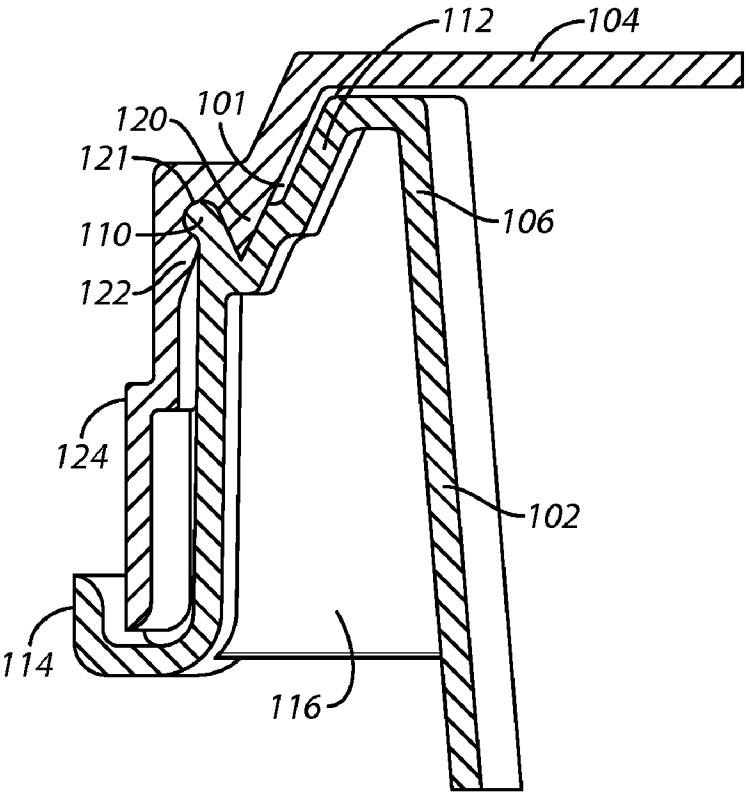
FIG. 2 is a diagram illustrating a side cross sectional view of the container and the lid of FIG. 1 after the film seal has been removed in accordance with one embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions, sizing, and/or relative placement of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will also be understood that the terms and expressions used herein have the ordinary meaning as is usually accorded to such terms and expressions by those skilled in the corresponding respective areas of inquiry and study except where other specific meanings have otherwise been set forth herein.

DETAILED DESCRIPTION

The following description is not to be taken in a limiting sense, but is made merely for the purpose of describing the general principles of the invention. The scope of the invention should be determined with reference to the claims. The present embodiments address the problems described in the background while also addressing other additional problems as will be seen from the following detailed description.

Figure 1:
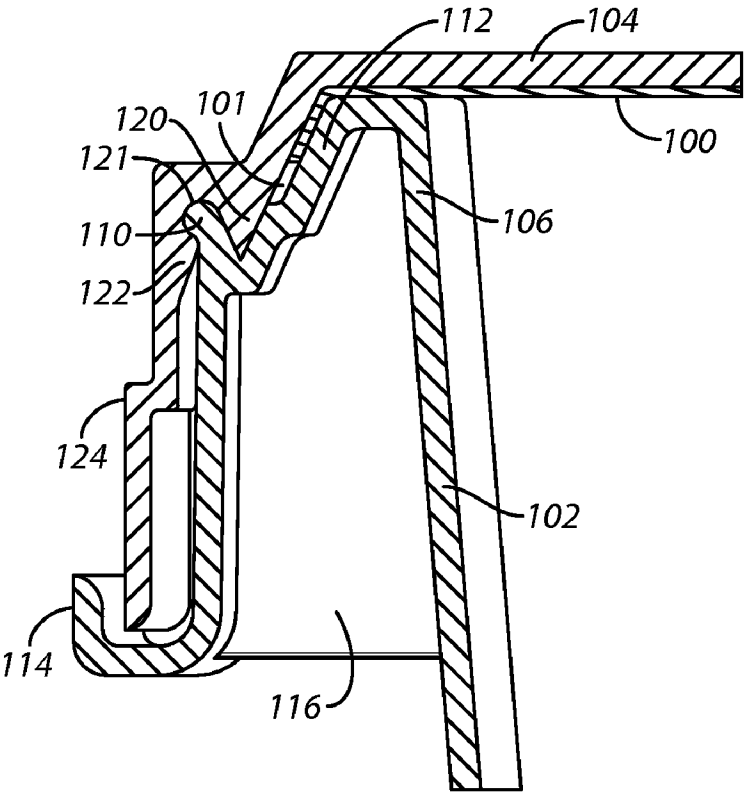
FIG. 1 is a diagram illustrating a side cross sectional view of a portion of a container having a film seal and a lid forming a secondary seal with the container in accordance with one embodiment.

Referring to FIG. 1, a diagram is shown illustrating a side cross sectional view of a portion of a container having a film seal and a lid forming a secondary seal with the container in accordance with one embodiment. Shown is a film seal 100, a gap 101, a container 102 that includes: an inner wall 106, a groove 108, a bead 110, an outer wall 112, a bumper return 114 and a rib support 116, and a lid 104 that includes: a top 118, a tongue 120, a clamp 121, an undercut 122 and an outer wall 124.

The film seal 100 provides a seal for the container 102 that is removable. Once removed, however, the film seal 100 is generally thrown away. That is, the film seal 100, once removed, does not get reapplied to the container 102. As described above, the container may contain products that are moisturized (e.g., moisture wipes) or products for which it is desirable to keep isolated from moisture (e.g., tea, coffee). The present embodiment provides a secondary seal for after the film seal 100 has been removed. FIG. 2 illustrates a side cross sectional view of the container and the lid of FIG. 1 after the film seal has been removed.

The secondary seal, in accordance with one embodiment, includes the tongue 120 and the groove 108. As shown, the tongue 120 is in the shape of a "V" such that the tongue 120 is easily lead into the groove 108 when placing the lid 104 back onto the container 102. While other shapes can function to provide the secondary seal, the "V" shape makes the lid 104 and container 102 much more user friendly. As the tongue 120 engages the groove 108, the lid 104 is going to be pushed upward and outward by the groove 108. In order to counter balance that force and provide a good seal, the container 102 includes the bead 110 and the lid 104 includes the clamp 121 and the undercut 122. The undercut 122 is a portion of the clamp 121.

The bead 110 and the clamp 121 act to provide a downward and inward force that counteracts the force between the tongue 120 and the groove 108 allowing the tongue 120 and groove 108 to provide a good secondary seal between the container 102 and the lid 104. That is, the clamp 121 grasps onto the bead 110 and pushes the tongue 120 down into the groove 108 to create the secondary seal. By forming the bead 110 in a direction upward and outward from the container 102, the proper force is applied to the tongue 120 and the groove 108. The bead 110 is wider than an opening of the clamp 121 such that the undercut 122 portion of the clamp 121 helps to create the downward and inward force for the secondary seal. While the bead 110 and the groove 108 are shown as part of the container 102 and the clamp 121 and the tongue 120 are shown as part of the lid 104 in accordance with the one embodiment, other embodiments can have any of these components integrated with either the lid 104 or the container 102 depending upon the specific design desired.

In one embodiment, the container 102 includes the outer wall 112 which has at least a portion that includes an outward slope. The outward slope makes it easier for a user to line up the tongue 120 and groove 108 when placing the lid 104 back on the container. Optionally, the gap 101 is provided between the outward slope portion of the outer wall 112 and the lid 104. The gap 101 is provided such that if portions of the film seal 100 are not completely removed the film seal 100 will not interfere with forming the secondary seal between the tongue 120 and the groove 108. In this embodiment, the outward slope includes a stepped portion before the groove 108 and the bead 110. Additionally, in this embodiment, the bead 110, the clamp 121, the tongue 120 and the groove 108 are all positioned below a flat portion of the top of the container 102 where the film seal 100 attaches to the container 102. This allows for the secondary seal to be formed outside of where the contents of the container are stored. Additionally, this configuration allows the secondary seal to be formed in an area where material from the film seal will not be left over after removal. Advantageously, this provides greater reliability in forming a good secondary seal. Preferably, as shown in FIG. 3, the secondary seal extends around the entire container 102.

The container 102 also optionally includes the bumper return 114. The bumper return 114 provides for a tamper evident container. Additionally, the tamper evident features will be described below with reference to FIGS. 5A-5C. As shown, the bumper return 114 is a "U" shaped outer rim portion of the container 102, however, other shapes may be optionally utilized. The bumper return 114 extends around substantially the entire container in the present embodiment. Another optional feature of the container 102 is the rib support 116. The rib support 116 is one or a plurality of supports located around the container that provide additional strength for the container 102. While the rib support 116 provides additional support for the container, the outward sloping portion of the container 102, the groove 108 and the bead 110 provide the hoop strength for the container.

The lid 104 includes the outer wall 124. Optionally, the outer wall 124 extends down into the bumper return 114 of the container 102 in order to provide a tamper evident feature for the lid 104 and container 102 (shown and described with reference to FIGS. 5A-5C). The outer wall 124 also optionally includes a stepped portion in order to provide a stacking feature for the lids (shown and described with reference to FIG. 7).

Figure 3:
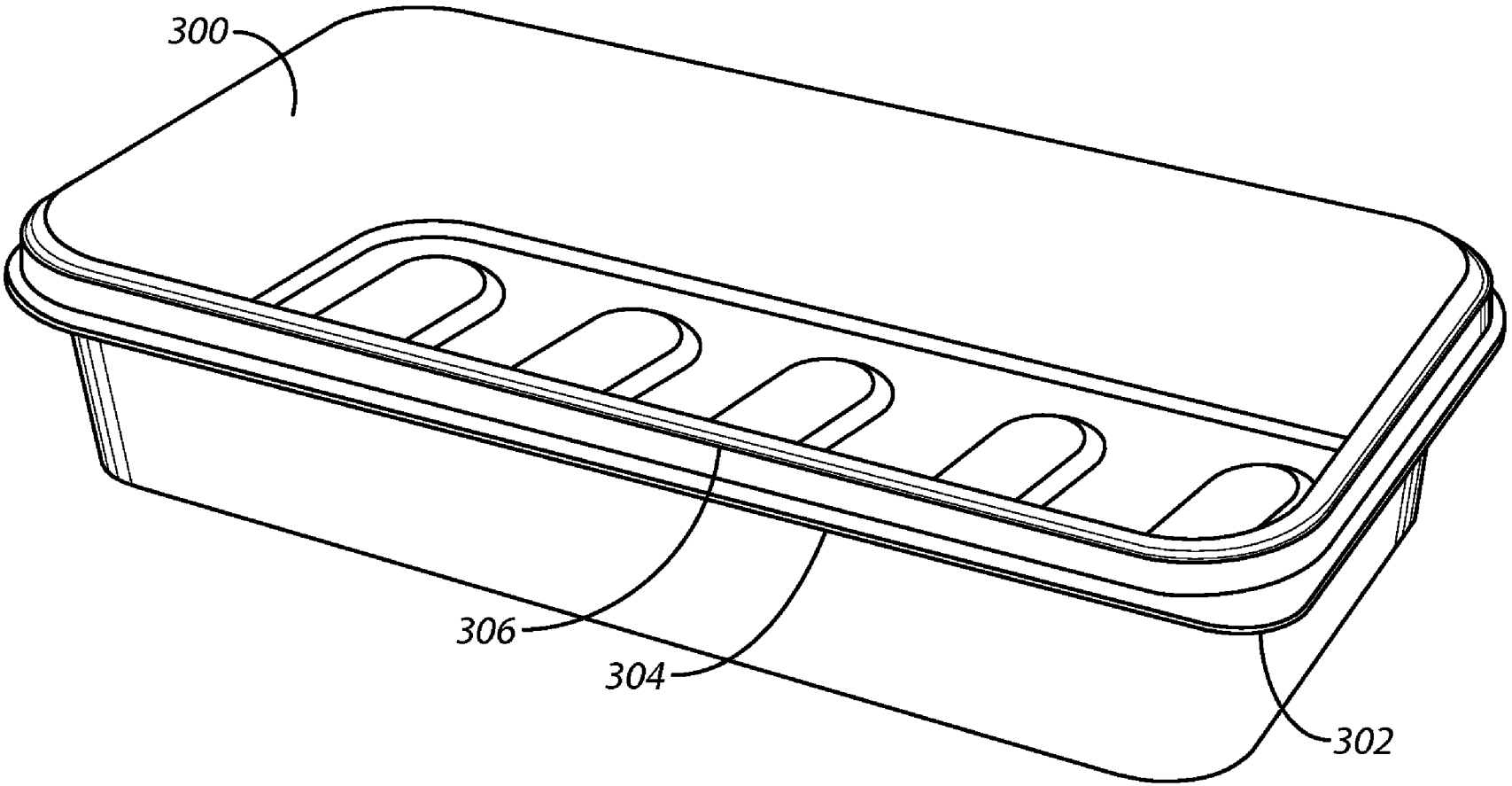
FIG. 3 is a diagram illustrating a three-dimensional view of a container in accordance with one embodiment.

Referring to FIG. 3, a diagram is shown illustrating a three-dimensional view of a container in accordance with one embodiment. Shown is a container 300, a break away corner tab 302, a bumper return 304 and a secondary seal 306.

The container 300 is shown with the lid removed. The optional break away corner tab 302 provides a tamper evident feature. After removal of the break away corner tab 302, the lid (not shown) is more easily removed from the container. The container 300 shown is a rectangular shape, however, other shapes for the container are utilized in alternative embodiments. For example, the container 300 can be round, square, oval, rectangular, triangular and other shapes in various embodiments. Additionally, the size and the depth of the container 300 varies in different embodiments depending upon the specific application and what is stored within the container 300.

Figure 4:
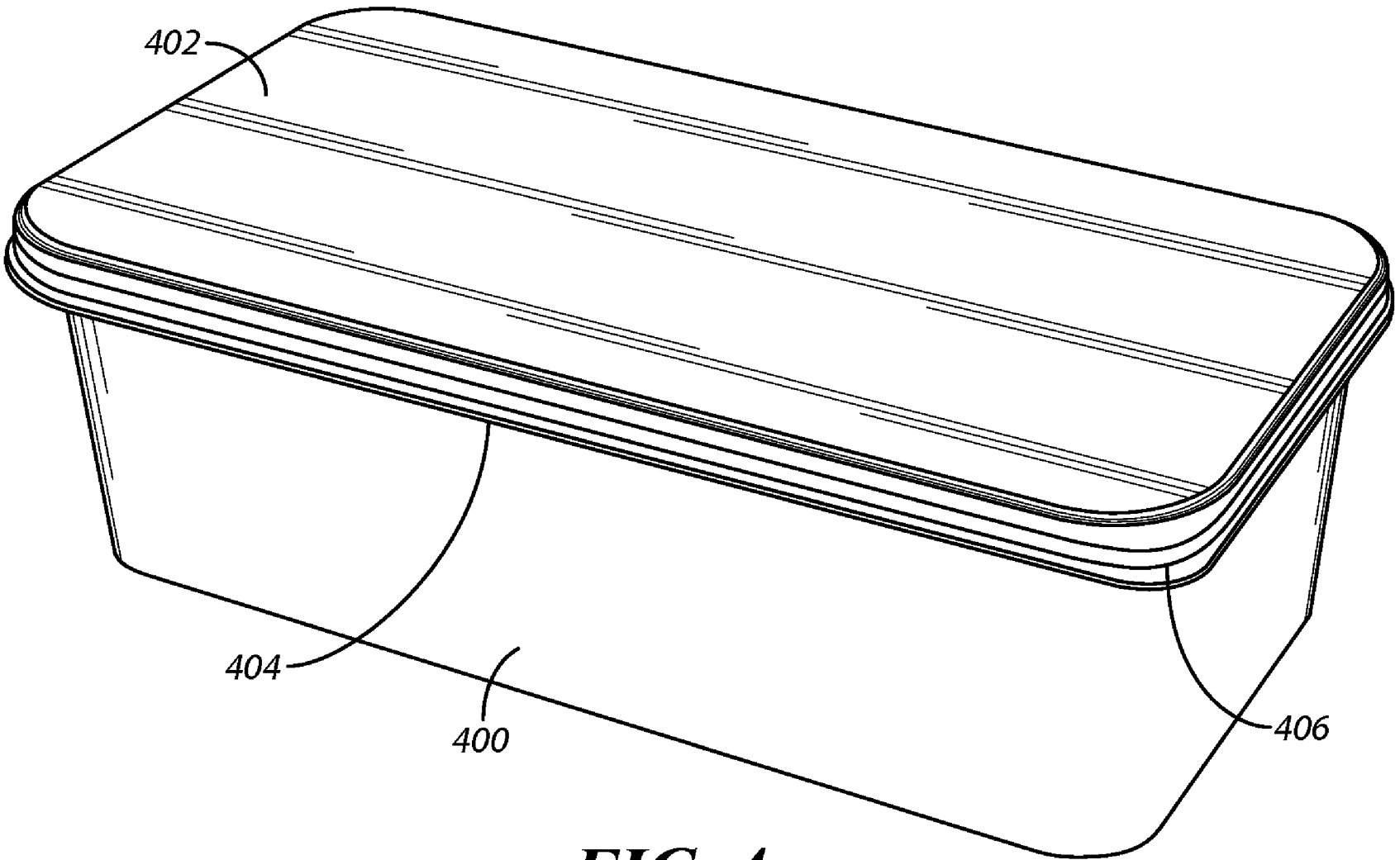
FIG. 4 is a diagram illustrating a three-dimensional view of a container and a lid in accordance with one embodiment.

Referring to FIG. 4, a diagram is shown illustrating a three-dimensional view of a container and a lid in accordance with one embodiment. Shown is a container 400, a lid 402, a bumper return 404 and a break away corner tab 406. The lid 402 is secured to the container 400. The break away corner tab 406 is intact, however, may be removed in order to more easily remove the lid 402 from the container 400.

Figure 5A:
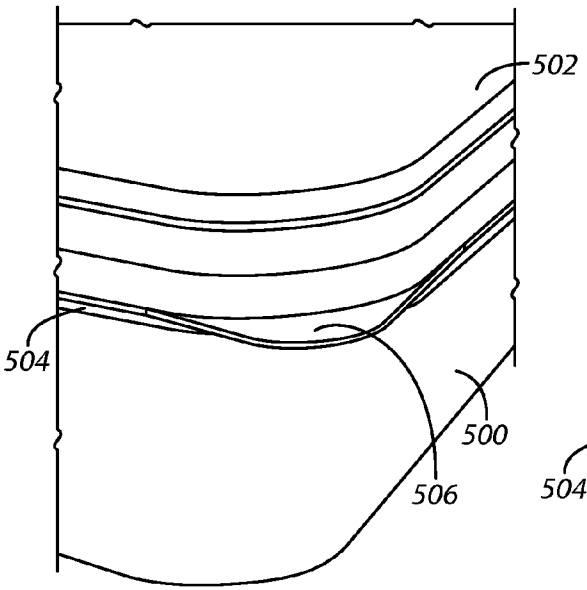
FIGS. 5A-5C are a sequence of a diagrams illustrating a break away tab for a container in accordance with one embodiment.
Figure 5B:
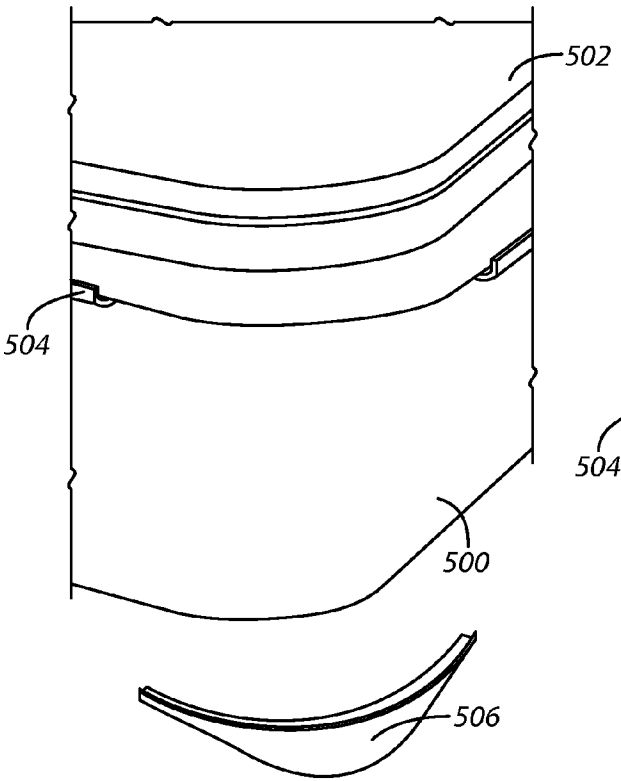
Figure 5C:
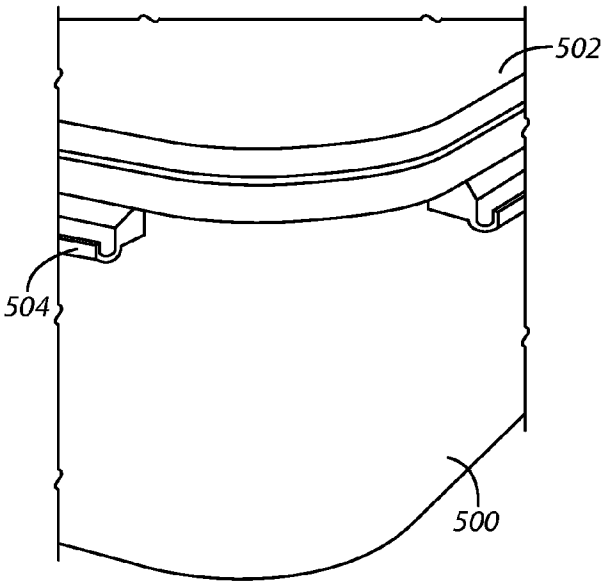

Referring next to FIGS. 5A-5C, shown are a sequence of a diagrams illustrating a break away tab for a container in accordance with one embodiment. Shown is a container 500, a lid 502, a bumper return 504 and a break away corner tab 506.

In FIG. 5A, the break away corner tab 506 is intact and the lid 502 is securely fastened to the container 500. In order to gain access to the lid 502 so that it can be removed, the break away corner tab 506 is removed as shown in FIG. 5B. The lid 502 can then be grasped by a user and the lid 502 can be removed from the container such as is shown in FIG. 5C. The bumper return 504 prevents the user from accessing the lid 502 from other places around the container 500. As stated above, the bumper return 504 and the break away corner tab 506 are optional features and only present in some embodiments.

Figure 6:
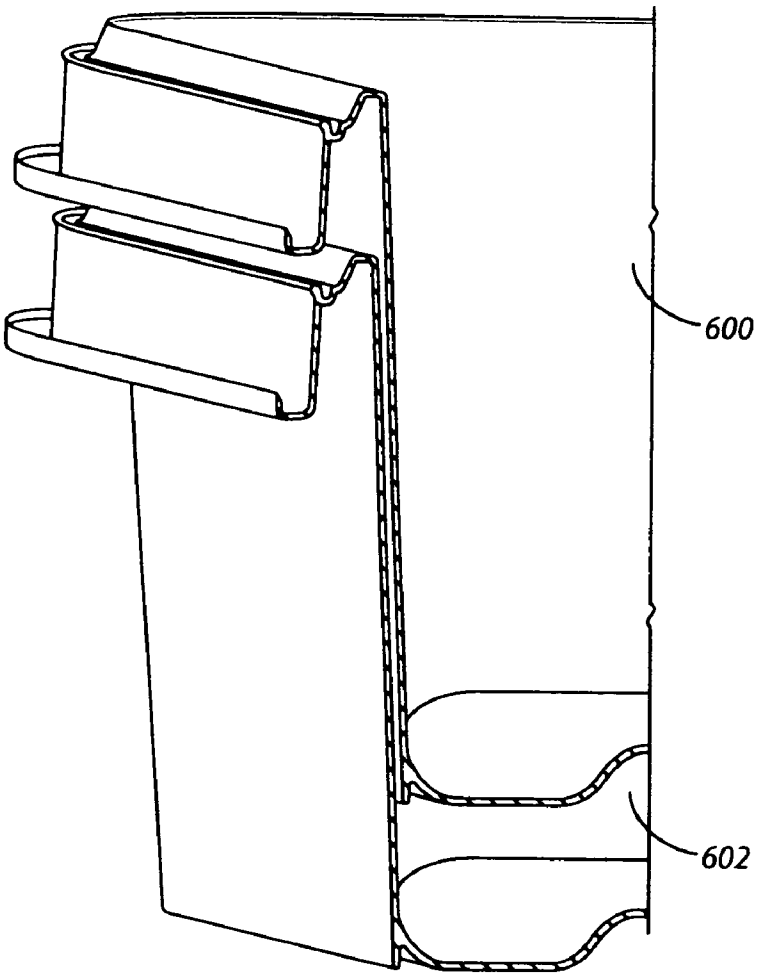
FIG. 6 is a diagram illustrating stackable containers in accordance with one embodiment.

Referring to FIG. 6, a diagram is shown illustrating stackable containers in accordance with one embodiment. Shown is a first container 600 and a second container 602. By providing a shape of the container such that it is stackable, the storage space required before the containers are filled with a product is greatly reduced.

Figure 7:
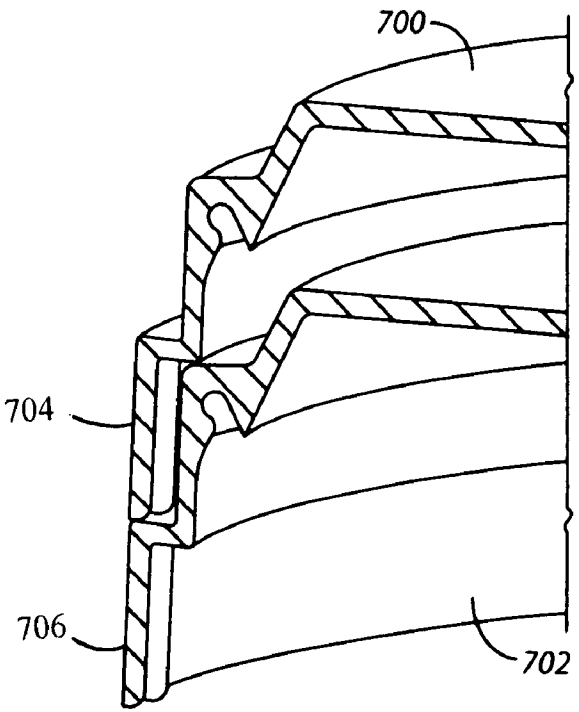
FIG. 7 is a diagram illustrating stackable lids in accordance with one embodiment.

Referring to FIG. 7, a diagram is shown illustrating stackable lids in accordance with one embodiment. Shown is a first lid 700, a second lid 702, a stepped outer wall 704 of the first lid and a stepped outer wall 706 of the second lid. Similarly to the containers, the lids are stackable in order to reduce the storage space needed before the lids are placed on the containers. In this manner, the stepped outer wall 704 of the first lid 700 engages with the stepped outer wall 706 of the second container 702.

While the invention herein disclosed has been described by means of specific embodiments and applications thereof, other modifications, variations, and arrangements of the present invention may be made in accordance with the above teachings other than as specifically described to practice the invention within the spirit and scope defined by the following claims.

I claim:

1. An apparatus for storing a product, comprising:
a lid including:
a tongue; and
a clamp; and
a container including:
an inner wall;
an outer wall, including a first portion extending outwardly from an upper end of the inner wall and a second portion extending downwardly from an outer end of the first portion;
a groove at an outer surface of the outer wall, wherein the tongue and the groove form a seal when the lid is coupled to the container; and
a bead at the outer surface of the outer wall, wherein the distance between the center of the bead and the inner wall of the container is greater than the distance between the center of the groove and the inner wall of the container, and wherein the clamp engages with the bead when the lid is coupled to the container.

2. The apparatus of claim 1, wherein the bead of the container and the clamp of the lid create a force that keeps the tongue of the lid engaged with the groove of the container.

3. The apparatus of claim 1, further comprising an undercut portion of the clamp.

4. The apparatus of claim 1, wherein the apparatus consists of a single piece lid and a single piece container.

5. The apparatus of claim 1, further comprising a film seal coupled to the outer wall of the container.

6. The apparatus of claim 5, wherein the bead, the clamp, the tongue and the groove are located below the film seal.

7. The apparatus of claim 5, wherein the first portion includes a outwardly and downwardly sloping portion, and wherein the outwardly and downwardly sloping portion includes a stepped portion.

8. An apparatus for storing a product, comprising:
a lid including:
a tongue; and
a clamp;
a container including:
an inner wall;
an outer wall, including a first portion extending outwardly from an upper end of the inner wall and a second portion extending downwardly from an outer end of the first portion;
a groove at an outer surface of the outer wall, wherein the tongue and the groove form a seal when the lid is coupled to the container; and
a bead at the outer surface of the outer wall, wherein the clamp engages with the bead when the lid is coupled to the container; and
a film seal coupled to the outer wall of the container,
wherein the first portion includes a outwardly and downwardly sloping portion, wherein the outwardly and downwardly sloping portion includes a stepped portion, and wherein a gap is formed above the stepped portion between the lid and the outwardly and downwardly sloping portion of the container.

9. The apparatus of claim 8, wherein the film seal is at least partially located in the gap that is formed between the lid and the container.

10. An apparatus for storing a product, comprising:
a lid including:
a tongue; and
a clamp; and
a container including:
an inner wall;
an outer wall, including a first portion extending outwardly from an upper end of the inner wall and a second portion extending downwardly from an outer end of the first portion;
a groove at an outer surface of the outer wall, wherein the tongue and the groove form a seal when the lid is coupled to the container; and
a bead at the outer surface of the outer wall, wherein the clamp engages with the bead when the lid is coupled to the container,
wherein the container includes a bumper return extending from the outer wall and the bumper return includes a break away corner.

11. A container and lid, comprising:
a base of a container;
an inner wall of the container extending upwardly from the container base;
an outer wall of the container, including a first portion extending outwardly from an upper end of the inner wall and a second portion extending downwardly from an outer end of the first portion, the outer wall including an upper surface configured to contact an edge portion of a film for sealing the top opening of the container;
a central portion of a lid configured to cover the top of the container;
a peripheral portion of the lid configured to extend below a top opening of the container;
a groove at an outer surface of the outer wall of the container;
a tongue at an inner surface of the peripheral portion of the lid configured to engage the groove;
a bead at the outer surface of the outer wall of the container, wherein the distance between the center of the bead and the inner wall of the container is greater than the distance between the center of the groove and the inner wall of the container; and
a clamp at the inner surface of the peripheral portion of the lid configured to engage the bead.

12. The container and lid of claim 11, further comprising:
a plurality of rib supports between the inner wall and the outer wall of the container.

13. The container and lid of claim 11, further comprising a film sealing the top opening of the container, the film including an edge portion contacting the upper surface of the outer wall.

14. The container and lid of claim 11, wherein the outer wall of the container includes a bumper return configured to prevent a user from removing a lid fastened to the container.

15. The container and lid of claim 14, wherein the bumper return includes a break away tab, the removal of which allows the user to remove the lid from the container.

16. The container and lid of claim 11, wherein the upper surface of the outer wall includes a flat portion.

17. The container and lid of claim 16, further comprising a film sealing the top opening of the container, the film including an edge portion contacting the flat portion of the upper surface of the outer wall.

18. The container and lid of claim 16, wherein the peripheral portion of the lid includes a flat portion corresponding to the flat portion of the upper surface of the outer wall.

19. The container and lid of claim 11, wherein the upper surface of the outer wall includes an outwardly sloping portion.

20. A container and lid of claim 19, further comprising:

a film sealing the top opening of the container, the film including an edge portion contacting the outwardly sloping portion of the upper surface of the outer wall.

21. The container and lid of claim 19, wherein the peripheral portion of the lid includes an outwardly sloping portion corresponding to the outwardly sloping portion of the outer wall.

22. A container and lid, wherein the container comprises:

an inner wall surrounding an inner cavity of the container; and an outer wall around the inner wall, the outer wall including: a first portion extending outwardly from an upper end of the inner wall; a second portion extending downwardly from an outer end of the first portion; a groove; and a bead, wherein the distance between the center of the bead and the inner wall of the container is greater than the distance between the center of the groove and the inner wall of the container; and wherein the lid comprises a peripheral portion, the peripheral portion including a tongue for contacting the groove and a clamp for clamping the bead.

23. The container and lid of claim 22, wherein the groove is at a lower end of the second portion of the outer wall of the container, the groove including first and second opposing surfaces, wherein the first surface is a portion of the outer surface of the second portion of the outer wall of the container.

24. The container and lid of claim 23, wherein the tongue includes a first surface for contacting the first surface of the groove and a second surface for contacting the second surface of the groove.

25. The container and lid of claim 22, wherein the container further comprises a removable film seal covering the inner cavity of the container.

26. The container and lid of claim 25, wherein the removable film seal contacts an upper surface of the first portion of the outer wall of the container.

27. The container and lid of claim 26, wherein a first part of the peripheral portion of the lid is configured to contact the removable seal on the upper surface of the first portion of the outer wall of the container.

28. The container and lid of claim 25, wherein the removable film seal contacts an upper surface of the second portion of the outer wall of the container.

29. The container and lid of claim 28, wherein a second part of the peripheral portion of the lid is configured to contact the removable seal on the outer surface of the second portion of the outer wall of the container.

30. A container and lid wherein the container comprises:

an inner wall surrounding an inner cavity of the container; and an outer wall around the inner wall, the outer wall including: a first portion extending outwardly from an upper end of the inner wall; a second portion extending downwardly from an outer end of the first portion; a groove; and a bead;

wherein the lid comprises a peripheral portion, the peripheral portion including a tongue for contacting the groove and a clamp for clamping the bead, wherein the groove is at a lower end of the second portion of the outer wall of the container, the groove including first and second opposing surfaces, wherein the first surface is a portion of the outer surface of the second portion of the outer wall of the container, and wherein the bead is at an upper end of the second surface of the groove.

31. A container and lid, wherein the container comprises:

an inner wall surrounding an inner cavity of the container; and an outer wall around the inner wall, the outer wall including: a first portion extending outwardly from an upper end of the inner wall; a second portion extending downwardly from an outer end of the first portion; a groove; and a bead;

wherein the lid comprises a peripheral portion, the peripheral portion including a tongue for contacting the groove and a clamp for clamping the bead, and wherein the outer wall of the container further includes a third portion extending downwardly from the bead.

32. The container and lid of claim 31, wherein the container further includes a plurality of rib supports contacting the inner wall and the third portion of the outer wall of the container.

33. The container and lid of claim 31, wherein the third part includes a stepped portion such that an outer surface of the third part below the stepped portion protrudes outwardly from an outer surface of the third part above the stepped portion.

34. The container and lid of claim 31, wherein the outer wall of the container further includes a fourth portion extending outwardly from the third portion of the outer wall of the container.

35. The container and lid of claim 34, wherein the outer wall of the container further includes a fifth portion extending upwardly from the fourth portion of the outer wall of the container.

36. The container and lid of claim 35, where the peripheral portion of the lid further includes a third part for extending to a space directly between the third and fifth portions of the outer wall of the container.

37. The container and lid of claim 34, wherein the fifth portion of the outer wall of the container includes a removable break away portion.

38. A container and lid, wherein the container comprises:

a base;

an inner wall extending upwardly and outwardly from the base and surrounding an inner cavity of the container;

an outer wall around the inner wall, the outer wall including:

a first portion extending outwardly from an upper end of the inner wall;

a second portion extending downwardly and outwardly from an outer end of the first portion, wherein the second portion includes a stepped portion such that an outer surface of the second portion below the stepped portion protrudes outwardly from an outer surface of the second portion above the stepped portion;

a groove at a lower end of the second portion, the groove including first and second opposing surfaces, wherein the first surface is a portion of outer surface of the second portion;

a bead at an upper end of the second surface of the groove;

a third portion extending downwardly from the bead;

a fourth portion extending outwardly from a lower end of the third portion;

a fifth portion extending upwardly from an outer end of the fourth portion, wherein the fifth portion includes a removable break away portion;

a removable film seal covering the inner cavity, the removable film seal contacting an upper surface of the first portion and an upper surface of the second portion; and a plurality of rib supports contacting the inner wall and the third portion of the outer wall; and wherein the lid comprises:

a central portion, including an edge portion for contacting the removable film seal on the upper surface of the first portion of the outer wall of the container;

a peripheral portion extending around the central portion, including:

a first part for contacting the removable film seal on the upper surface of the first portion of the outer wall of the container;

a second part for contacting the removable film seal on the upper surface of the second portion of the outer wall of the container and contacting the outer surface of the second portion of the outer wall of the container below the stepped portion;

a tongue at a lower end of the second part, including a first surface for contacting the first surface of the groove and a second surface for contacting the second surface of the groove;

a clamp for clamping the bead; and a third part for extending to a space directly between the third and fifth portions of the outer wall of the container, wherein the third part includes a stepped portion such that an outer surface of the third part below the stepped portion protrudes outwardly from an outer surface of the third part above the stepped portion.

* * * * *